US006623094B2

(12) United States Patent
Murakami

(10) Patent No.: US 6,623,094 B2
(45) Date of Patent: Sep. 23, 2003

(54) INK JET RECORDING DEVICE

(75) Inventor: Hiroki Murakami, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/984,216

(22) Filed: Oct. 29, 2001

(65) Prior Publication Data

US 2002/0113834 A1 Aug. 22, 2002

(30) Foreign Application Priority Data

Feb. 21, 2001 (JP) ..... 2001-45244

(51) Int. Cl.[7] ..... B41J 2/07
(52) U.S. Cl. ..... 347/18
(58) Field of Search ..... 347/18, 85, 65; 165/104.19, 104.28, 104.33

(56) References Cited

U.S. PATENT DOCUMENTS 5,850,234 A * 12/1998 Kneezel et al. ..... 347/18

6,386,672 B1 * 5/2002 Kimura et al. ..... 347/18

* cited by examiner

*Primary Examiner*—Craig Hallacher
(74) *Attorney, Agent, or Firm*—Morgan, Lewis & Bockius LLP

(57) ABSTRACT

An ink jet recording head having improved printing performance and improved manufacturing efficiency, a manufacturing method of the ink jet recording head, and an ink jet recording device. A head chip in which nozzles for jetting ink droplets are formed is fitted in an opening of an ink manifold via rubber sealing members, and the chip is exposed to the interior of ink supply chambers. Thus, the chip is efficiently cooled by the ink, and the temperature of the ink can be controlled so as to be within a predetermined range. Accordingly, no heat sink is necessary, and as a result, the head is easily manufactured and made compact. Since the chip is fitted in the manifold opening via the sealing members, application of an adhesive and curing time are unnecessary. Thus, manufacturing efficiency is improved.

20 Claims, 19 Drawing Sheets

102(104,106)
42A(42B,42C)
49A(49B,49C)
30A
30B
12
100
62
90
96
16
14
58

92(94,96)
42A (42B,42C)
49A (49B,49C)
44(46,48)
40

INK JET RECORDING DEVICE

BACKGROUND OF THE INVENTION

1. Field of the Invention

The present invention relates to an ink jet recording head which jets ink droplets onto a recording medium to form an image, a manufacturing method of the ink jet recording head, and an ink jet recording device.

2. Description of the Related Art

In recent years, ink jet recording devices have received attention as inexpensive color recording devices able to produce high quality images. As ink jet recording heads for the ink jet recording devices, there are known, for example, a piezoelectric ink jet recording head which jets ink from nozzles by the pressure generated by mechanically deforming a pressure chamber using a piezoelectric material, and a thermal ink jet recording head which energizes a heating element displaced in the individual channels, and then jets ink from nozzles by the pressure generated by the vaporized ink.

In the aforementioned thermal ink jet recording head, the temperature of the ink is raised above the temperature set by the heating element by heat generated at the time the ink is jetted. Thus, a problem arises in that this further increase in the ink temperature changes the viscosity of the ink and therefore the printing characteristics. Because of this problem, heat dissipation is ensured by structuring the ink jet recording head such that a heat sink, which is plate-shaped and has high heat conductivity, is joined to a lower surface of a head chip in which nozzles are formed.

A manufacturing method of such an ink jet recording head will be described briefly with reference to FIGS. 17A to 17D.

First, a flexible printed wiring board 202 is joined onto a heat sink 200 (see FIG. 17A). Next, a head chip 204 having nozzles for jetting ink formed therein is joined onto the heat sink 200 (see FIG. 17B). Subsequently, connecting terminals 205 formed at end portions of the head chip 204 in a longitudinal direction thereof (i.e., in a direction in which the nozzles are aligned) are connected to terminals of the flexible printed wiring board 202 by wire bonding (FIG. 17C). The head chip 204 and the heat sink 200 are interposed between a pair of members forming an ink supply structure 206 which supplies ink to the head chip 204. The head chip 204 and the heat sink 200 are fixed to the ink supply structure 206 by screws 210 inserted into holes 208 of the heat sink 200 (FIG. 17D).

The ink jet recording head 211 having a heat sink is manufactured in the above-described manner. However, in addition to devising still further improvements in printing performance and manufacturing efficiency, the following tasks remain.

When an attempt is made to make an ink jet recording device (or a recording head) compact, the heat sink and the flexible printed wiring board, which are not components essential for jetting ink, need to be removed or made compact.

However, as described above, the heat sink serves to control the temperature of ink (i.e., ink jetting performance). Therefore, in place of the heat sink, a structure which is simple and serves to control the ink temperature (i.e., suppress a further increase in the ink temperature) is necessary.

Further, in order to ensure ink sealing ability, the heat sink 200 of an ink jet recording device shown in FIG. 18 is fixed to the ink supply structure 206 by the screws 210. The screws 210 are inserted into the holes 208 on both sides of the heat sink 200 where the head chip 204 for jetting ink droplets is connected. Accordingly, pairs of conveying rollers 212 and 214, which are disposed at the upstream and downstream sides, respectively, of the ink supply structure 206 in a direction in which paper is conveyed, are arranged to be spaced from the head chip 204 (i.e., printing area) by a distance corresponding to the diameter of the screw 210. In this case, however, printing performance may deteriorate due to, for example, a distortion of the back end of paper passing through the pair of conveying rollers 212. This may be particularly problematic when further high image quality is desired.

Furthermore, when an attempt is made to make the head chip 204 compact, the standardized size of a head portion of the screw 210 becomes large relative to the size of the head chip 204. Therefore, the head portion of the screw 210 is located at a position protruding further toward a position A at which paper is conveyed than a nozzle end face of the head chip 204 (FIGS. 19A and 19B). With this structure, the distance between the nozzles of the head chip 204 and the paper conveying position A is too large, and therefore, inadequate printing, such as no ink droplets reaching the paper, may be caused. Moreover, this structure also has a problem in that a sliding member for removing solidified ink, dust, and the like adhered on the nozzle end face of the head chip 204 cannot be slid along the head chip 204 because of the protruding screws 210.

A thermosetting resin adhesive is used to join members forming the ink jet recording head, for example, the heat sink and the head chip, to each other. In this case, a problem arises in that time is necessary for curing and for cooling after curing, thereby decreasing manufacturing efficiency. Accordingly, there has been a demand for eliminating a curing (adhering) step from the manufacturing process of the ink jet recording head.

SUMMARY OF THE INVENTION

In order to solve the above-described problems, the present invention provides an ink jet recording head which improves printing performance and simplifies manufacture, a manufacturing method of the ink jet recording head, and an ink jet recording device.

In accordance with an aspect of the present invention, there is provided an ink jet recording head comprising: a plurality of nozzles for jetting ink; a plurality of separate channels each corresponding to one of the plurality of nozzles; a plurality of common liquid chambers each communicating with one or more of the plurality of separate channels; and a plurality of ink supply chambers each communicating with one of the plurality of common liquid chambers, wherein the respective common liquid chambers open towards a direction in which the separate channels extend, and open towards a direction substantially perpendicular to the direction in which the separate channels extend so as to communicate with the corresponding ink supply chambers.

In accordance with another aspect of the present invention, there is provided a heatsinkless recording head having substantially no heat sink, the recording head comprising: a head chip formed by laminated substrates; an ink manifold having an opening for accommodating the head chip; and an elastic sealing element interposed between the head chip and the ink manifold when the head chip is accommodated in the ink manifold.

In accordance with yet another aspect of the present invention, there is provided a manufacturing method of an ink jet recording head, the method comprising the steps of: providing a head chip which includes a plurality of nozzles for jetting ink, a plurality of separate channels each corresponding to one of the plurality of nozzles, and a plurality of common liquid chambers each communicating with one or more of the plurality of separate channels; providing an ink manifold which includes a plurality of ink supply chambers each communicating with one of the common liquid chambers; and assembling the head chip and the ink manifold in such a way that the respective common liquid chambers open towards a direction in which the separate channels extend, and open towards a direction substantially perpendicular to the direction in which the separate channels extend so as to communicate with the corresponding ink supply chambers.

In accordance with a further aspect of the present invention, there is provided an ink jet recording device, comprising: (a) an ink jet recording head including: a plurality of nozzles for jetting ink; a plurality of separate channels each corresponding to one of the plurality of nozzles; a plurality of common liquid chambers each communicating with one or more of the plurality of separate channels; and a plurality of ink supply chambers each communicating with one of the plurality of common liquid chambers, wherein the respective common liquid chambers open towards a direction in which the separate channels extend, and open towards a direction substantially perpendicular to the direction in which the separate channels extend so as to communicate with the corresponding ink supply chambers; (b) an ink cartridge mounted at the ink jet recording head; and (c) a drive unit for moving the ink jet recording head and the ink cartridge in a scanning direction substantially perpendicular to a direction in which paper is conveyed.

In accordance with a still further aspect of the present invention, there is provided an ink jet recording device, comprising: (a) a heatsinkless ink jet recording head having substantially no heat sink, including: a head chip formed by laminated substrates; an ink manifold having an opening for accommodating the head chip; and an elastic sealing element interposed between the head chip and the ink manifold when the head chip is accommodated in the ink manifold; (b) an ink cartridge mounted at the ink jet recording head; and (c) a drive unit for moving the ink jet recording head and the ink cartridge in a scanning direction substantially perpendicular to a direction in which paper is conveyed.

BRIEF DESCRIPTION OF THE DRAWINGS

Preferred embodiments of this invention will be described in details based on the followings, wherein:

FIG. 1A shows the ink jet recording head before assembly, and FIG. 1B shows the ink jet recording head after assembly;

FIG. 10A shows the ink jet recording head before assembly, and FIG. 10B shows the ink jet recording head after assembly;

DESCRIPTION OF THE PREFERRED EMBODIMENTS

An ink jet recording head, an ink jet recording device, and a manufacturing method of the ink jet recording head according to a first embodiment of the present invention will be described.

First, the ink jet recording head will be described with reference to FIGS. 1A through 10B.

Figure 2A:
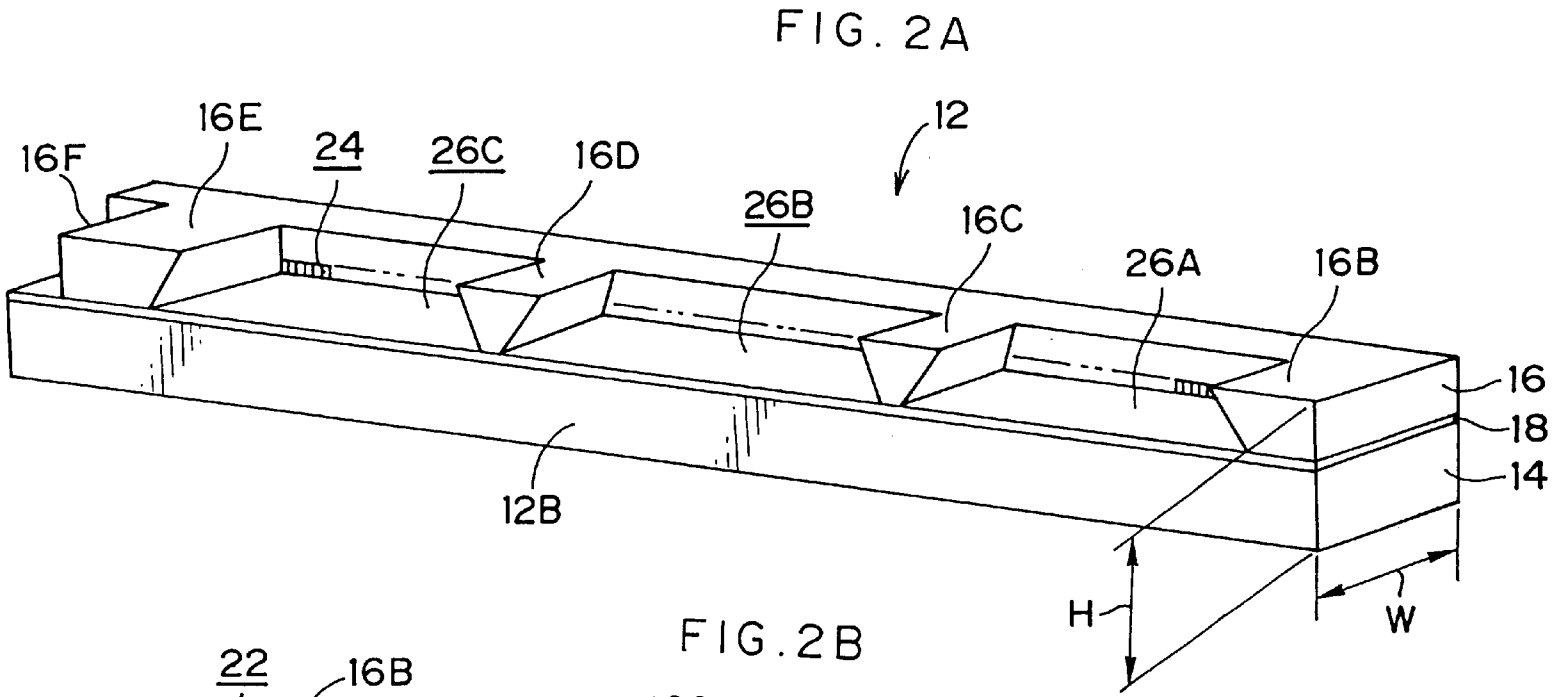
FIG. 2A is a perspective view of a head chip according to the first embodiment.
Figure 2B:
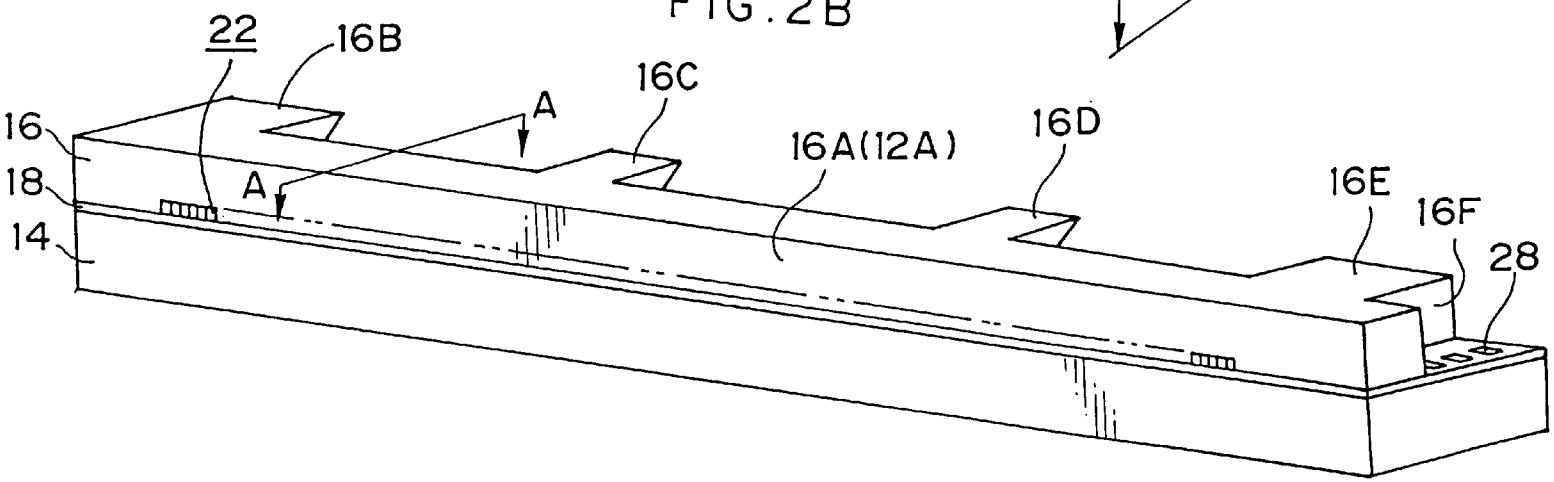
FIG. 2B is a perspective view of the head chip viewed from a side thereof opposite to the side shown in FIG. 2A.
Figure 3:
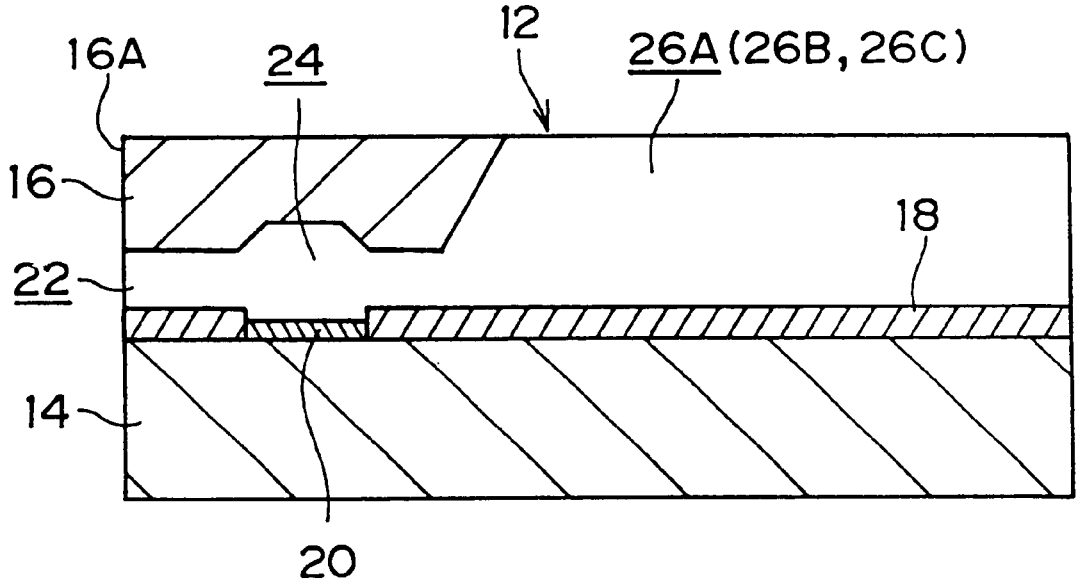
FIG. 3 is a cross sectional view of the head chip taken along line A—A in FIG. 2B.

As shown in FIGS. 2A and 2B, a head chip 12 forming an ink jet recording head 10 is formed by laminating a channel substrate 16 having ink channels formed therein and a heating element substrate 14 having heating elements 20 (see FIG. 3) for jetting ink.

A protective layer 18 for protecting wiring from ink is formed on the surface of the heating element substrate 14. Disposed at a portion of the protective layer 18 is the heating element 20, which heats ink so that an ink droplet is jetted.

Separate channels 24 are formed on the surface of the channel substrate 16 which is laminated on the heat element substrate 14 via the protective layer 18. The separate channels 24 respectively supply ink to a plurality of nozzles 22 which are open toward an end surface 16A of the laminated structure. Three common liquid chambers 26A to 26C, which are separated from one another by beams 16B to 16E, are formed at the rear side of the separate channels 24 and open towards two directions which are perpendicular to each other.

When the head chip 12 is mounted to an ink manifold 30 (described later), the common liquid chambers 26A to 26C communicate with corresponding ink supply chambers of the ink manifold 30.

A notch 16F is formed at the rear side of the nozzles 22 at one end portion of the channel substrate 16 in a longitudinal direction thereof. A connecting terminal 28 formed on the heating element substrate 14 is exposed by the notch 16F and connected to a flexible printed wiring board 66 which will be described later.

Next, the ink jet recording head 10 which includes the head chip 12 having the above structure, and the manufacturing method of the ink jet recording head 10 will be described.

Figure 4:
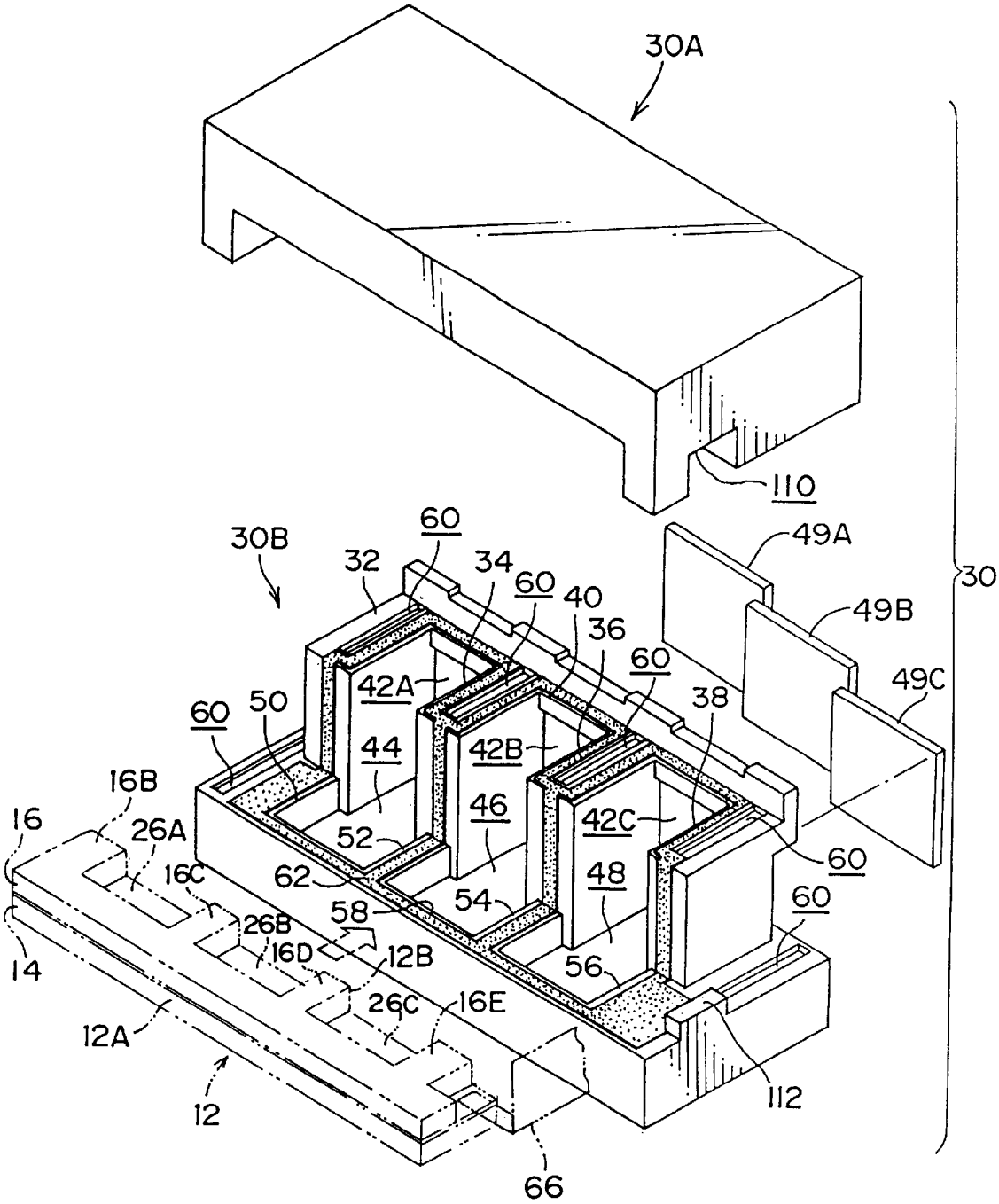
FIG. 4 is an exploded perspective view of the ink jet recording head according to the first embodiment.

As shown in FIG. 4, the ink manifold 30 (ink supplying structure) which supplies ink to the head chip 12 is formed by an upper body 30A and a lower body 30B which are made of resin. The ink jet recording head 10 is formed by combining the ink manifold 30 with the head chip 12.

Figure 5A:
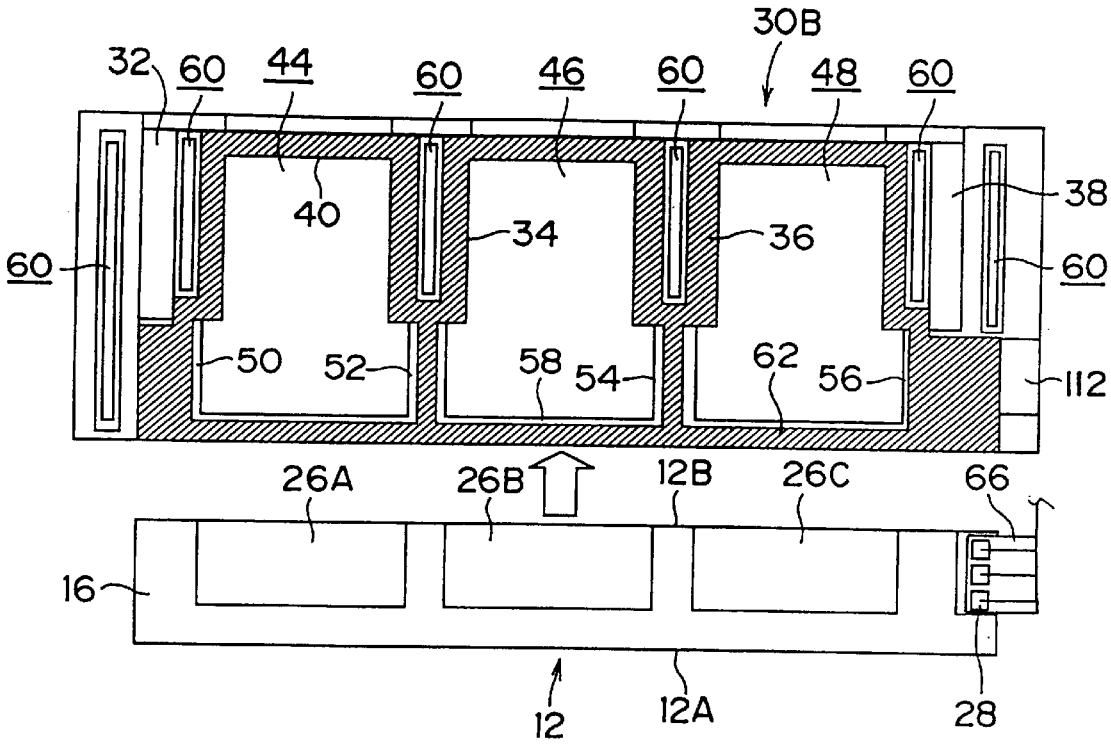
FIGS. 5A and 5B are plan views respectively showing the states before and after the head chip is mounted on a lower body according to the first embodiment.

As shown in FIGS. 4 and 5A, the lower body 30B is formed in a rectangular shape when seen in plan view. Walls 32, 34, 36, and 38 (hereinafter referred to as the "walls 32 to 38") extend from one end of the lower body 30B to the halfway point of the lower body 30B along a transverse direction thereof and are formed at predetermined intervals in a longitudinal direction of the lower body 30B. A wall 40 extending in the longitudinal direction of the lower body 30B is connected to one end of each of the walls 32 to 38. Openings 42A, 42B, and 42C for supplying ink are formed in the wall 40, and filters 49A, 49B, and 49C are fitted in the openings 42A, 42B, and 42C, respectively (FIG. 4).

Concave portions 44, 46, and 48 (hereinafter referred to as the "concave portions 44 to 48") respectively constituting ink supply chambers 102, 104, and 106, which will be described later, are formed between the adjacent walls 32 to 38, respectively. Namely, at the other end of the lower body 30B in the transverse direction thereof, which end opposes the walls 32 to 38, walls 50, 52, 54, and 56 (hereinafter referred to as the "walls 50 to 56") and a wall 58 are formed. Walls 50 to 56 are shorter than the walls 32 to 38. The wall 58 extends in the longitudinal direction of the lower body 30B so as to be connected to one end of each of the walls 50 to 56. The length of each of the walls 50 to 56 in the transverse direction of the lower body 30B is the same as the width W of the head chip 12 (FIG. 2A).

Depressions for engagement 60 having tapered surfaces are formed in the end portions of the lower body 30B in the longitudinal direction thereof and in the top surfaces of the walls 32 to 38. When the upper body 30A and the lower body 30B are combined together, protrusions for engagement 98 of the upper body 30A (FIG. 6) are inserted into the depressions for engagement 60 of the lower body 30B. Then, the depressions for engagement 60 and the protrusions for engagement 98 are joined to each other by ultrasonic fusing.

Figure 7A:
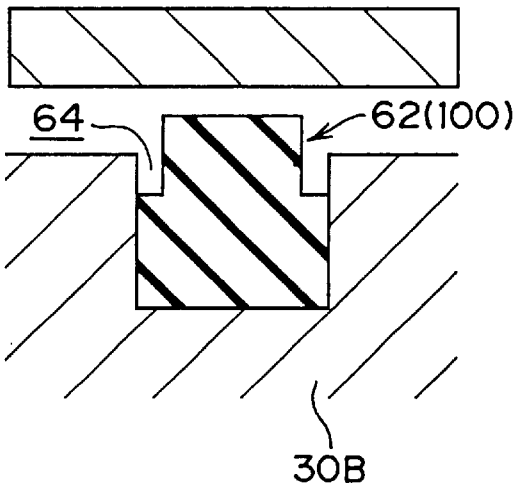
FIGS. 7A and 7B are views of a rubber sealing member according to the first embodiment, respectively showing the states before and after the rubber sealing member is pressed into a groove.
Figure 7B:
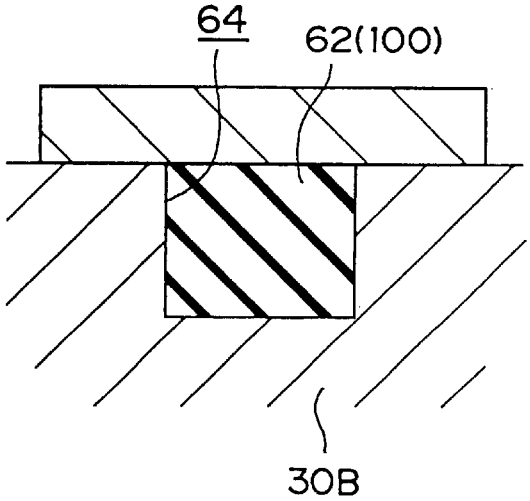

A rubber sealing member 62 is formed at the top surfaces and the side surfaces of the walls 32 to 38, 40, 50 to 56, and 58 so as to surround the concave portions 44 to 48. As shown in FIG. 7A, the rubber sealing member 62 is formed inside a groove 64 which is formed on the surface of the lower body 30B. The rubber sealing member 62 has a shape of a rectangle having a width smaller than that of the groove 64 stacked on a rectangle whose cross section is approximately equal to that of the groove 64, so that the small rectangle portion protrudes from the groove 64. The rubber sealing member 62 and the lower body 30B made of resin are integrally formed in two different colors.

A convex portion 112 is formed at a portion of the wall 56 (FIG. 4). The convex portion 112 is inserted into a concave portion 110 of the upper body 30A at the time of assembly such that a hole for inserting the flexible printed wiring board 66 is formed.

Figure 6:
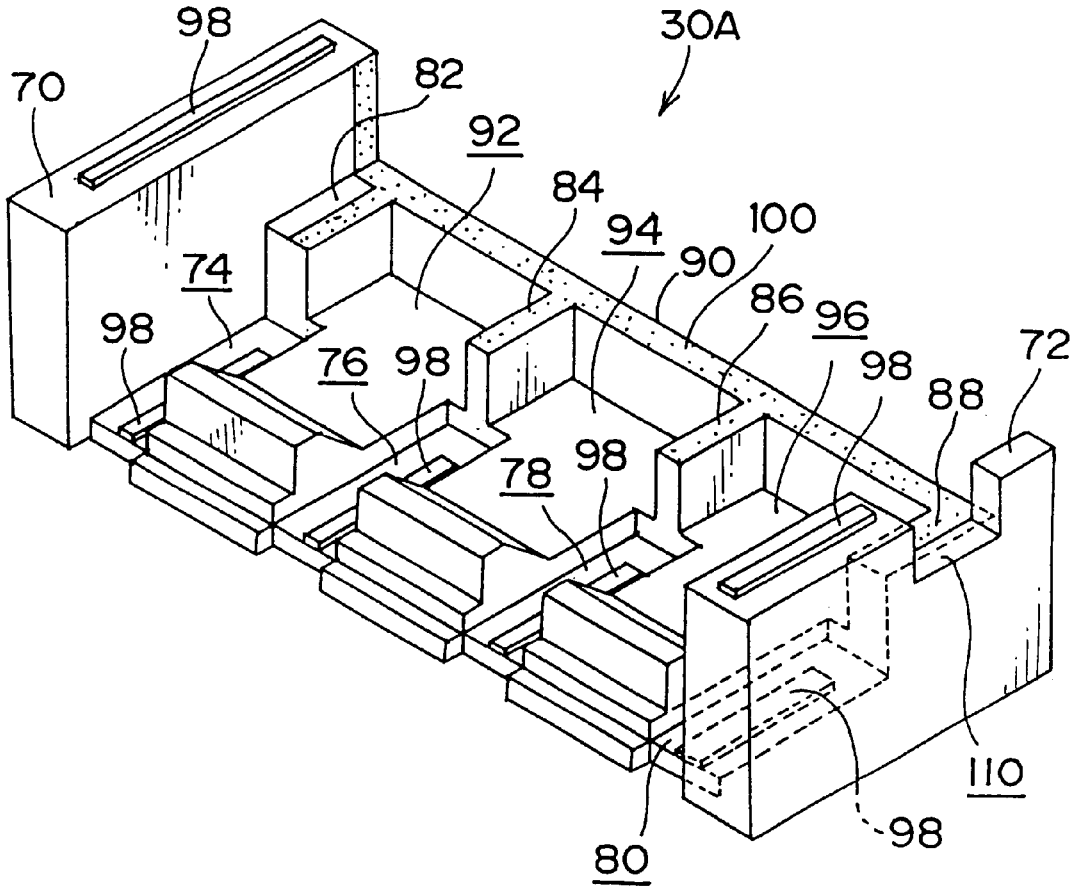
FIG. 6 is a perspective view of an upper body according to the first embodiment.

As shown in FIG. 6, walls 70 and 72, and depressions 74, 76, 78, and 80 (hereinafter referred to as the "depressions 74 to 80") are formed at the upper body 30A. The walls 70 and 72 extend in a transverse direction of the upper body 30A at the end portions thereof in a longitudinal direction. The depressions 74 to 80 are formed between the walls 70 and 72 at predetermined intervals and abut against the walls 32 to 38 of the lower body 30B, respectively.

Walls 82, 84, 86, and 88 (hereinafter referred to as the "walls 82 to 88") are formed so as to be connected to the ends of the depressions 74 to 80 in the transverse direction of the upper body 30A, respectively. The walls 82 to 88 also connect to a wall 90 which is at one end portion of the upper body 30A in the transverse direction thereof and extends in the longitudinal direction. Concave portions 92, 94, and 96 (hereinafter referred to as the "concave portions 92 to 96") are formed in a space delineated by the depressions 74 to 80 and the walls 82 to 88.

Figure 9:
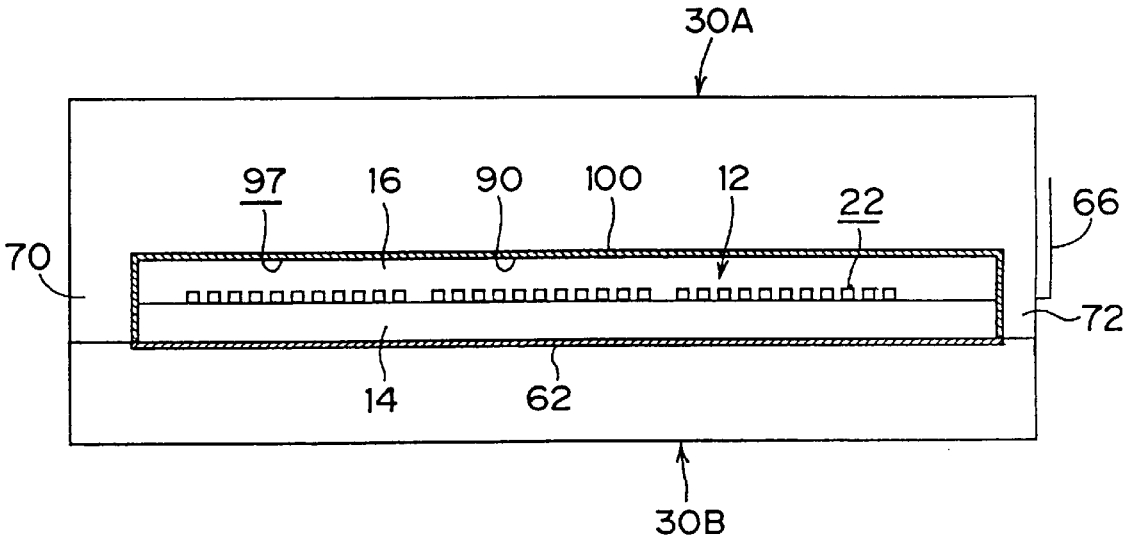
FIG. 9 is a frontal view of the ink jet recording head according to the first embodiment.

The height of the walls 82 to 88 and 90 is lower than that of the walls 70 and 72 by the height (thickness) H of the head chip 12. When the upper body 30A and the lower body 30B are combined together, the top surface of the wall 90 and the side surfaces of the walls 70 and 72 define an opening 97 for the head chip 12 (FIG. 9).

At the bottom surfaces of the walls 70 and 72 and the depressions 74 to 80, protrusions for engagement 98 which are inserted into the depressions for engagement 60 of the lower body 30B are formed.

In the same way as for the formation of the rubber sealing member 62, a rubber sealing member 100 is formed at the top surface of the wall 90, the side surfaces of the walls 70 and 72, and the top surfaces of the walls 82 to 88 which form the opening 97.

A concave portion 110 for inserting the flexible printed wiring board 66 is formed at a portion of the wall 72.

Using the upper body 30A and the lower body 30B formed as described above, the ink jet recording head 10 is formed in the following manner.

First, an electrode of the flexible printed wiring board 66 is placed on the connecting terminal 28 of the head chip 12 and connected thereto by ultrasonic joining (see FIG. 5A). Subsequently, the head chip 12 is slid on the walls 50 to 56 of the upper body 30B such that the rear surface 12B of the head chip 12 at the common liquid chamber side abuts against the walls 32 to 38 (see FIGS. 4, 5A, and 5B). Since the length of each of the walls 50 to 56 in the transverse direction of the lower body 30B is equal to the width W of the head chip 12, the nozzle end face 12A of the head chip 12 is flush with an end face of the ink manifold 30.

Subsequently, the upper body 30A is assembled onto the lower body 30B. Namely, assembly is carried out such that the walls 70 and 72 of the upper body 30A are disposed on the outer sides of the walls 32 and 38 of the lower body 30B. The protrusions for engagement 98 which are formed on the top surfaces of the walls 70 and 72 and the bottom surfaces of the depressions 74 to 80 of the upper body 30A are inserted into the depressions for engagement 60 which are formed in the end portions and the upper surfaces of the walls 32 to 38 of the lower body 30B.

As a result, the walls 32 to 38 of the lower body 30B are inserted into and abut against the depressions 74 to 78 of the upper body 30A. The walls 82 to 88 of the upper body 30A abut against the beams 16B to 16E, respectively, of the head chip 12 placed on the lower body 30B and engage with the side surfaces of the walls 32 to 38.

Figure 10B:
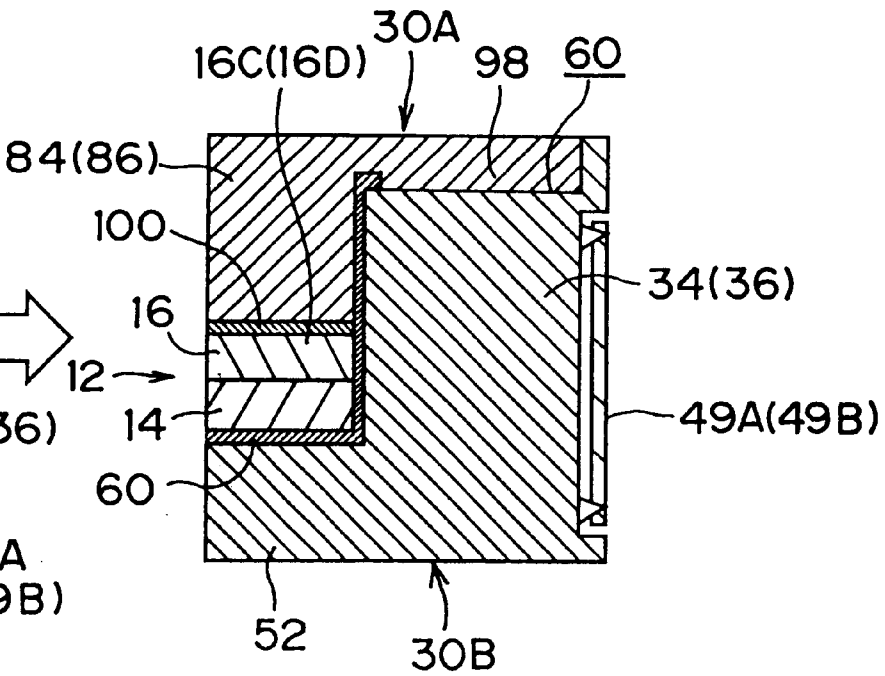
FIGS. 10A and 10B are cross sectional views of the ink jet recording head according to the first embodiment, taken along line C—C in FIG. 8.
Figure 10A:
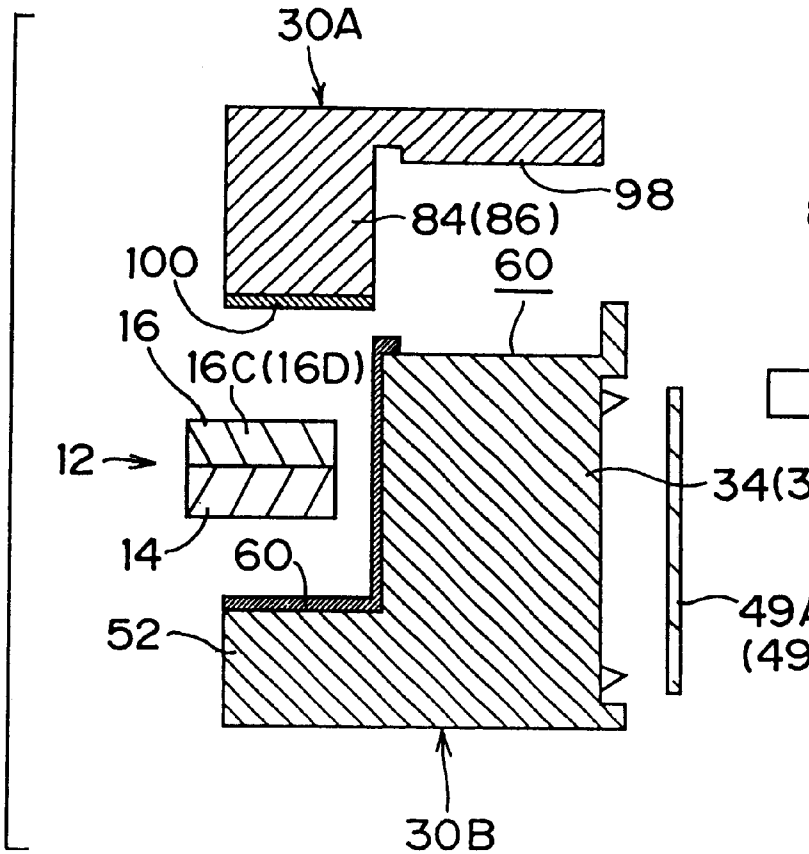

Accordingly, the walls 32 to 38 of the lower body 30B and the corresponding walls 82 to 88 of the upper body 30A are disposed in a straight line when viewed from above (see FIGS. 10A and 10B). Thus, the three ink supply chambers 102, 104, and 106 (hereinafter referred to as the "ink supply chambers 102 to 106") are formed by the concave portions 44 to 48 of the lower body 30B and the concave portions 92 to 96 of the upper body 30A (see FIGS. 1A and 1B).

Figure 8:
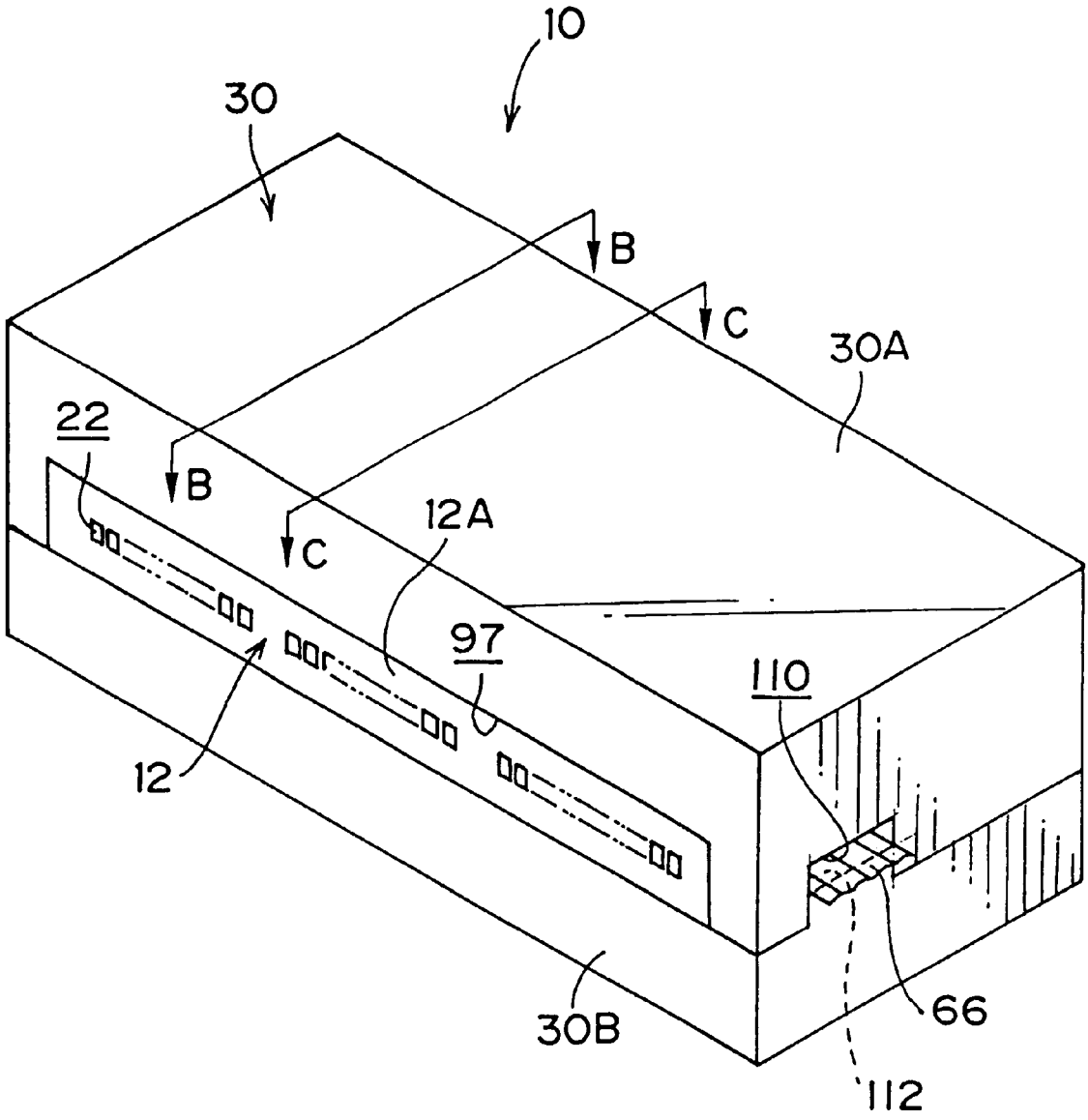
FIG. 8 is a perspective view of the ink jet recording head according to the first embodiment.

As shown in FIG. 8, the nozzle end face 12A is exposed to the outside through the opening 97 formed by the upper body 30A and the lower body 30B.

Moreover, in the side surface of the ink jet recording head 10 (i.e., the wall 70), a hole is formed by partially fitting the convex portion 112 into the concave portion 110. The flexible printed wiring board 66 extends to the outside through the hole.

The upper body 30A and the lower body 30B are combined together by joining the protrusions for engagement 98 and the depressions for engagement 60 by ultrasonic fusing.

As shown in FIG. 10B, at the boundaries of the ink supply chambers 102 to 106, the walls 34 and 36 of the lower body 30B, the corresponding walls 84 and 86 of the upper body 30A, and the beams 16C and 16D of the head chip 12 are disposed in alignment when seen in top view, thereby delineating the adjacent ink supply chambers 102 to 106.

The boundaries are securely sealed by the rubber sealing member 100 of the upper body 30A and the rubber sealing member 62 of the lower body 30B. Thus, there is no mixing of ink in the adjacent ink supply chambers.

Figure 5B:
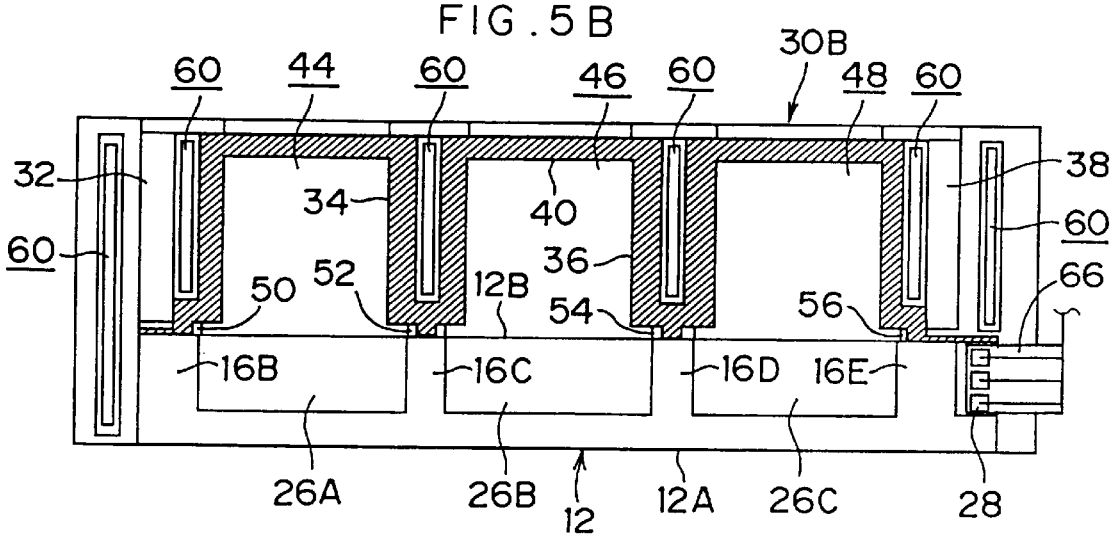

As shown in FIG. 5B, since the connecting terminal 28 is provided at only one end of the head chip 12 in the longitudinal direction thereof, the flexible printed wiring board 66 connected to the connecting terminal 28 can be immediately taken out of the ink manifold 30, and the head chip 12 can be made compact.

As shown in FIG. 9, at the opening 97 where the head chip 12 is exposed to the outside, the area surrounding the head chip 12 is completely sealed by the rubber sealing member 100 of the upper body 30A and the rubber sealing member 62 of the lower body 30B. Thus, ink does not leak from the ink supply chambers 102 to 106 to the outside.

Further, as described above, the rubber sealing members 62 and 100 seal in a state of being contained in (i.e., in a state of not protruding from) the grooves 64 formed at the surfaces of the upper body 30A and the lower body 30B, respectively, and the head chip 12 directly abuts against the surfaces of the upper body 30A and the lower body 30B. Thus, it is possible to eliminate a case in which the orientation of the head chip 12 is changed due to a deformation of the rubber sealing members 62 and 100, thereby causing displacement of the direction in which ink is jetted. Namely, the head chip 12 can be positioned and fixed with high accuracy.

Figures 1A, 1B:
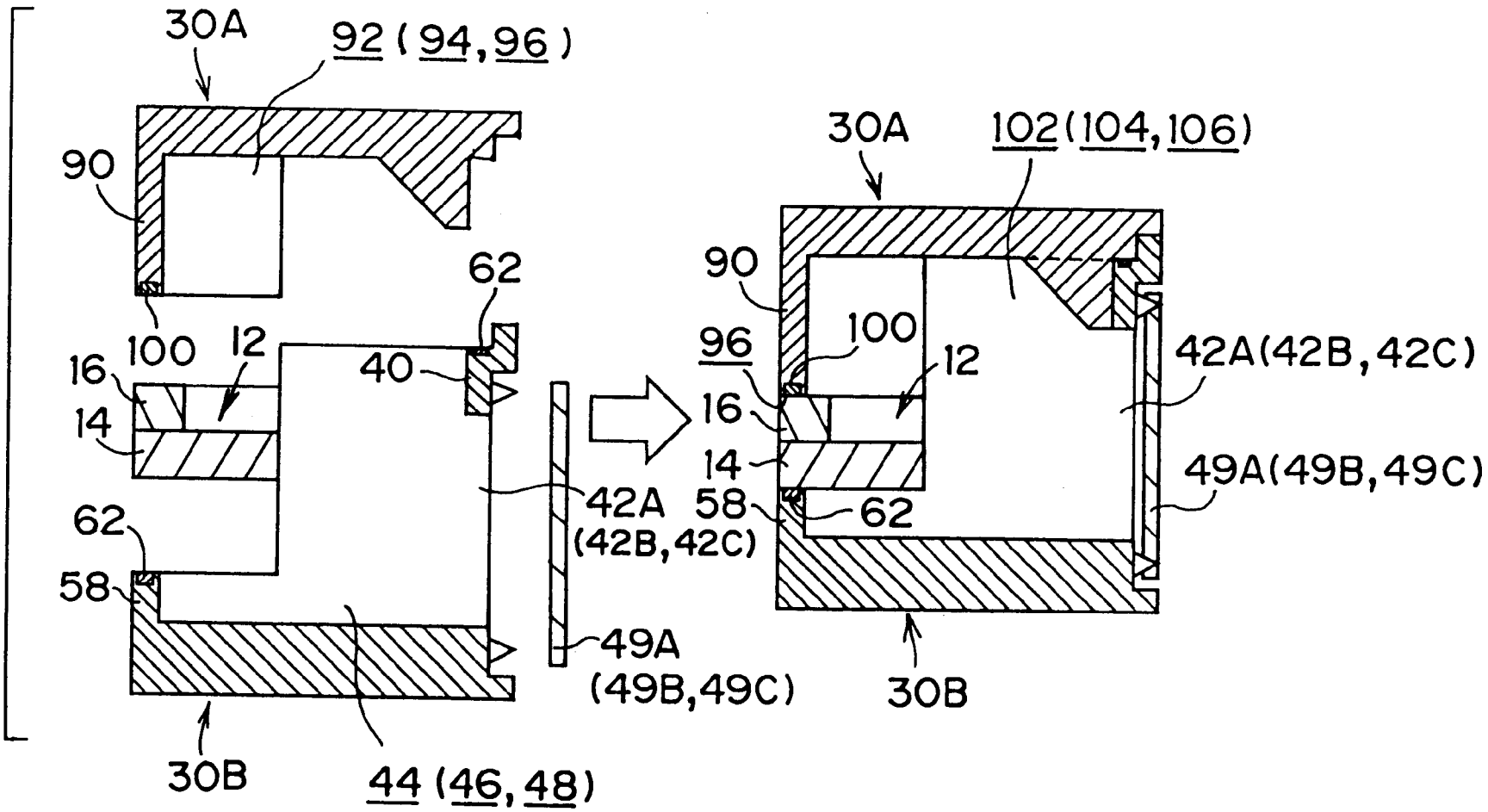
FIGS. 1A and 1B are cross sectional views of an ink jet recording head according to a first embodiment of the present invention, taken along line B—B in FIG. 8.

Moreover, as shown in FIGS. 1B and 10B, the head chip 12 is supported only by the opening 97 of the ink manifold 30 and the walls 50 to 56. The common liquid chambers 26A to 26C communicate well with the corresponding ink supply chambers 102 to 106, respectively. With this structure, ink contained in the ink supply chambers 102 to 106 can contact not only the channel substrate 16 but also the bottom surface of the heating element substrate 14 (see FIG. 1B). As a result, an increase in the temperature of the head chip 12 (ink), which accompanies the jetting of the ink, can be suppressed, and appropriate temperature control can be carried out. Accordingly, for the ink jet recording head 10 formed by the head chip 12 and the ink manifold 30, no heat sink is necessary, and the size of the ink jet recording head 10 and the number of parts can be reduced.

Since the temperature of the head chip 12 can be controlled by the ink, the temperature of the ink can be controlled so as to be in a predetermined temperature range (25° C. to 75° C.). Therefore, the viscosity of ink before jetting can be decreased, and ink which has high viscosity and does not run after adhering to paper can be jetted. As a result, print quality can be improved.

In the manufacturing method of the ink jet recording head 10, joining steps other than the joining of the upper body 30A and the lower body 30B by ultrasonic fusing can be omitted. Therefore, adhesive applying time and curing time required in joining steps can be significantly reduced, and manufacturing efficiency can be improved. Thermal fusing by vibration, thermal fusing by electromagnetic induction fusion, a fitting system, and the like can be used as other joining methods for the upper body 30A and the lower body 30B.

In the recording head 10 of the present embodiment, the connecting terminal 28 is provided at one end portion of the head chip 12 in the direction in which nozzles are aligned, and electrical signals are directly outputted to the outside via the flexible printed wiring board 66. Since it is not necessary to provide the flexible printed wiring board 66 within the ink supply chambers 102, 104, and 106, problems concerning resistance to ink of the flexible printed wiring board are not caused. Further, as compared with a recording head in which connecting terminals are provided at both end portions of a flexible printed wiring board, the flexible printed wiring board 66 can be made compact, thereby reducing cost.

In the present embodiment, the connecting terminal 28 is provided at one end portion of the flexible printed wiring board 66. However, the connecting terminal 28 may be provided at both end portions. In this case, the connecting terminal 28 can also be provided at the end portions of the printed wiring board 66 in such a way that the printed wiring board 66 is not disposed in the ink supply chambers 102, 104, and 106.

Hereinafter, an ink cartridge 130 having the above-described recording head 10, and an ink jet recording device 150 having the ink cartridge 130 mounted therein will be briefly described with reference to FIGS. 11 to 15.

Figure 11:
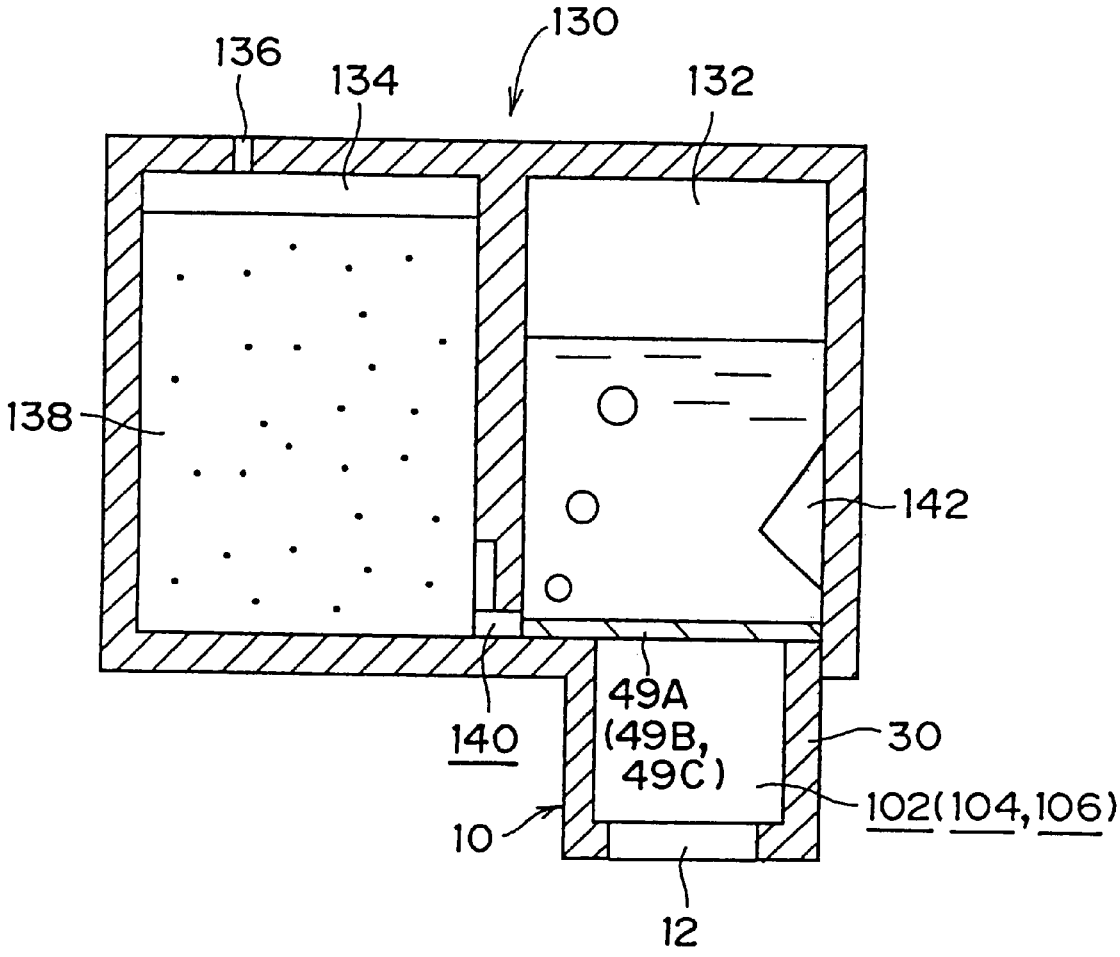
FIG. 11 is a cross-sectional view schematically showing an ink cartridge according to the first embodiment.

As shown in FIG. 11, the ink cartridge 130 has a first ink chamber 132 and a second ink chamber 134. In the first ink chamber 132, ink is held so as to have a free surface. The second ink chamber 132 supplies ink to the first ink chamber 132 while controlling the negative pressure of the first ink chamber 132. Air in the second ink chamber 134 is released through a communicating hole 136, and the second ink chamber 134 has a porous member 138 impregnated with ink. Further, the second ink chamber 134 is connected to the first ink chamber 132 via a connecting hole 140.

The ink manifold 30 (i.e., the ink jet recording head 10) is integrally formed below the first ink chamber 132, and the first ink chamber 132 is connected via the filters 49A to 49C to the ink supply chambers 102 to 106 of the ink manifold 30. This structure is constructed so that ink of a single color, for example, black, can be supplied from the first ink chamber 132 via the filters 49A to 49C to the respective ink supply chambers 102 to 106.

The first ink chamber 132 has a prism 142. The prism 142 is used by the ink jet recording device 150 to optically detect the amount of ink remaining in the first ink chamber 132.

Figure 12:
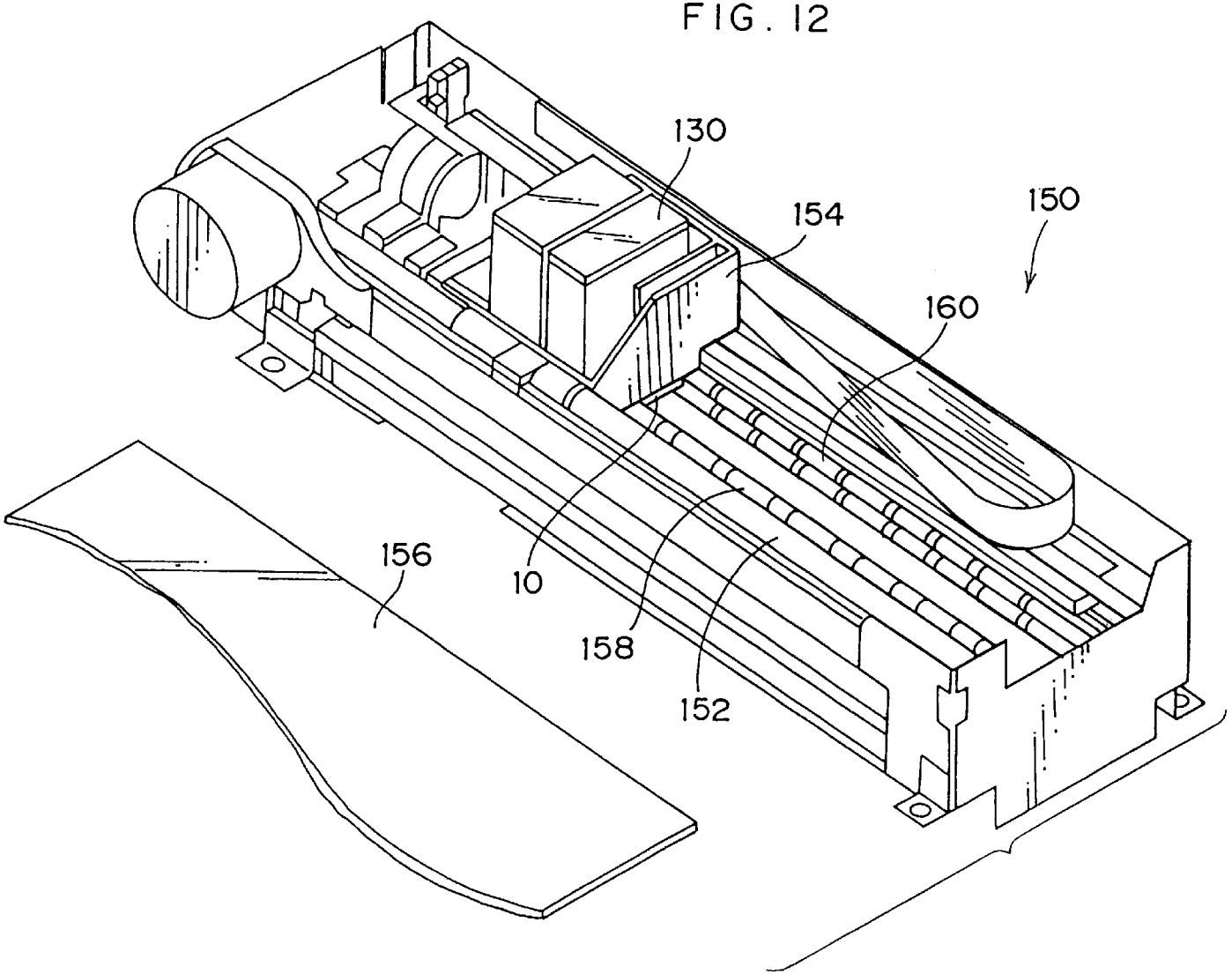
FIG. 12 is a perspective view of an ink jet recording device according to the first embodiment.

FIG. 12 shows the ink jet recording device 150 in which the ink cartridge 130 having the above structure is mounted on a carriage 154 which moves along a guide shaft 152.

Figure 13:
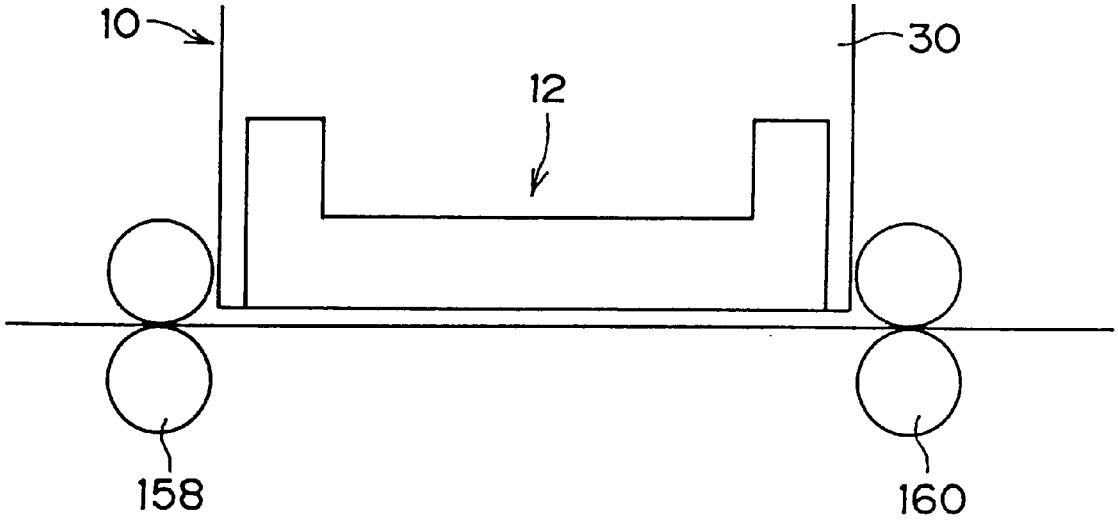
FIG. 13 is a view showing the positional relationship between pairs of conveying rollers and the head chip of the ink jet recording device.

In the device 150, paper 156 is conveyed in a direction perpendicular to a direction in which the carriage 154 (i.e., the recording head 10) moves along the guide shaft 152 for scanning. As shown in FIGS. 12 and 13, in order to prevent distortion of the paper 156 printed by the recording head 10, pairs of conveying rollers 158 and 160 are respectively disposed at the upstream and downstream of the ink jet recording head 10 along a direction in which the paper 156 is conveyed.

Figure 18:
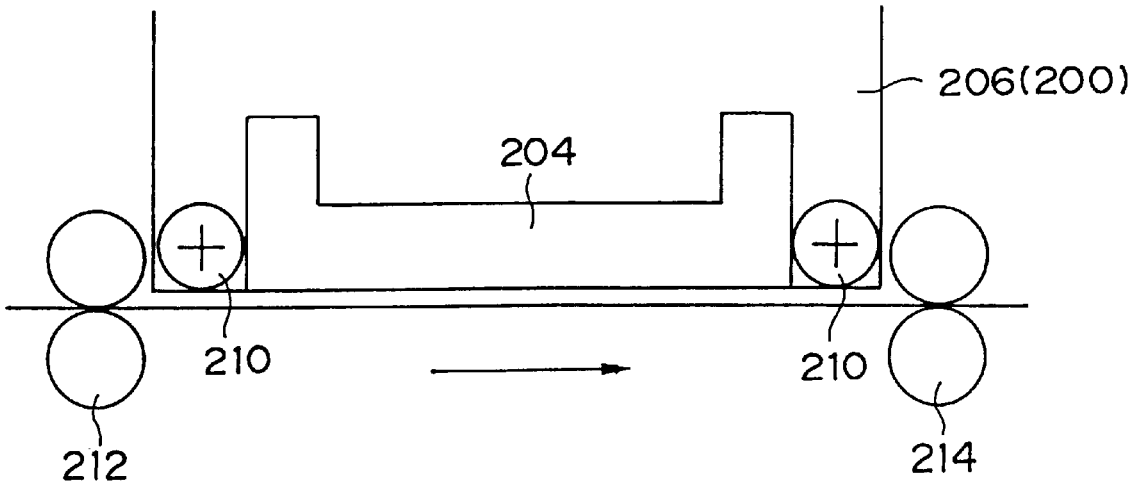
FIG. 18 PRIOR ART
FIG. 18 is a view showing the positional relationship between pairs of rollers and a head chip according to a prior art embodiment.
Figure 19A:
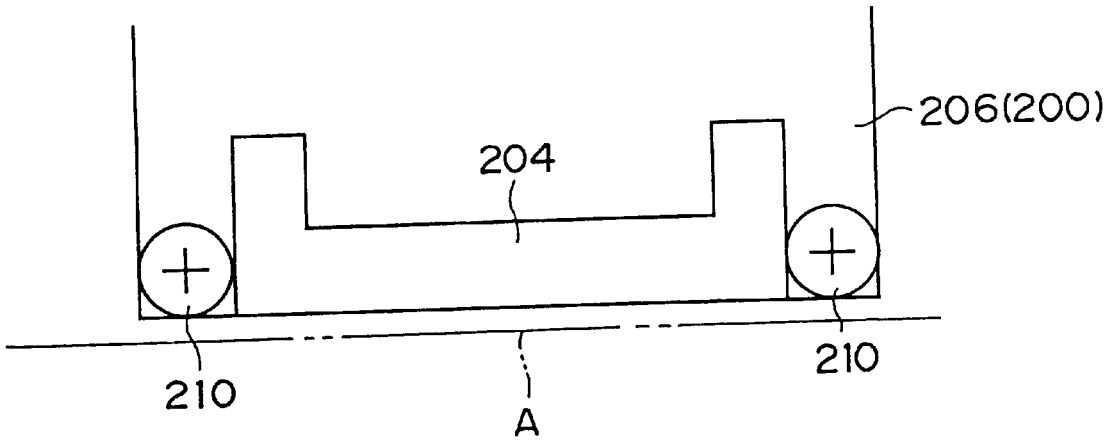
FIG. 19A PRIOR ART
FIG. 19A is a view showing the positional relationship between screws and the head chip according to a prior art embodiment.
Figure 19B:
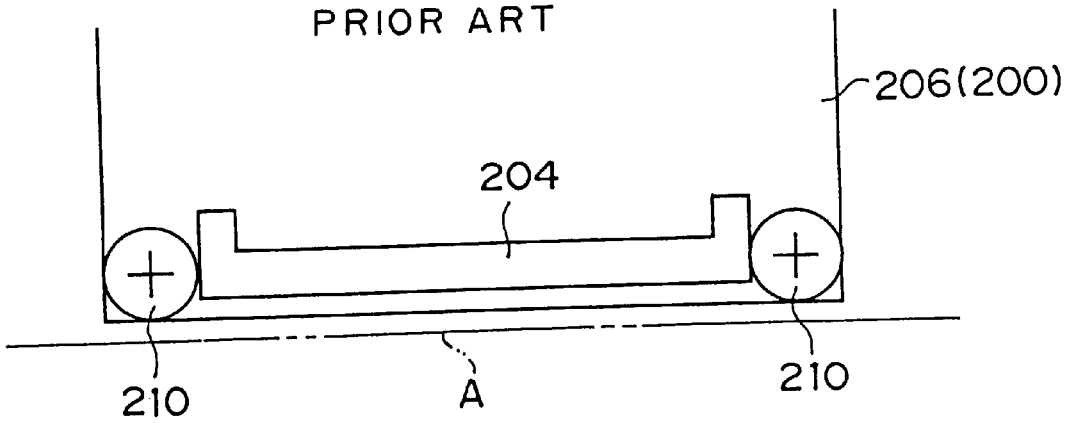
FIG. 19B PRIOR ART
FIG. 19B is a view showing a disadvantage which is caused when the head chip is made compact.

Since the ink cartridge 130 having the above structure is mounted in the ink jet recording head 150, no heat sink is necessary, and therefore, the recording head can be made compact. As compared with a conventional example (see FIG. 18) in which a screw is disposed at both end portions of a head chip, the pairs of conveying rollers 158 and 160 can be disposed near an area in which the nozzles of the head chip 12 are disposed (i.e., the printing area)(FIG. 13). Accordingly, the paper 156 can be accurately conveyed to a printing position (i.e., a position facing the head chip), and printing performance can be improved.

Figure 14:
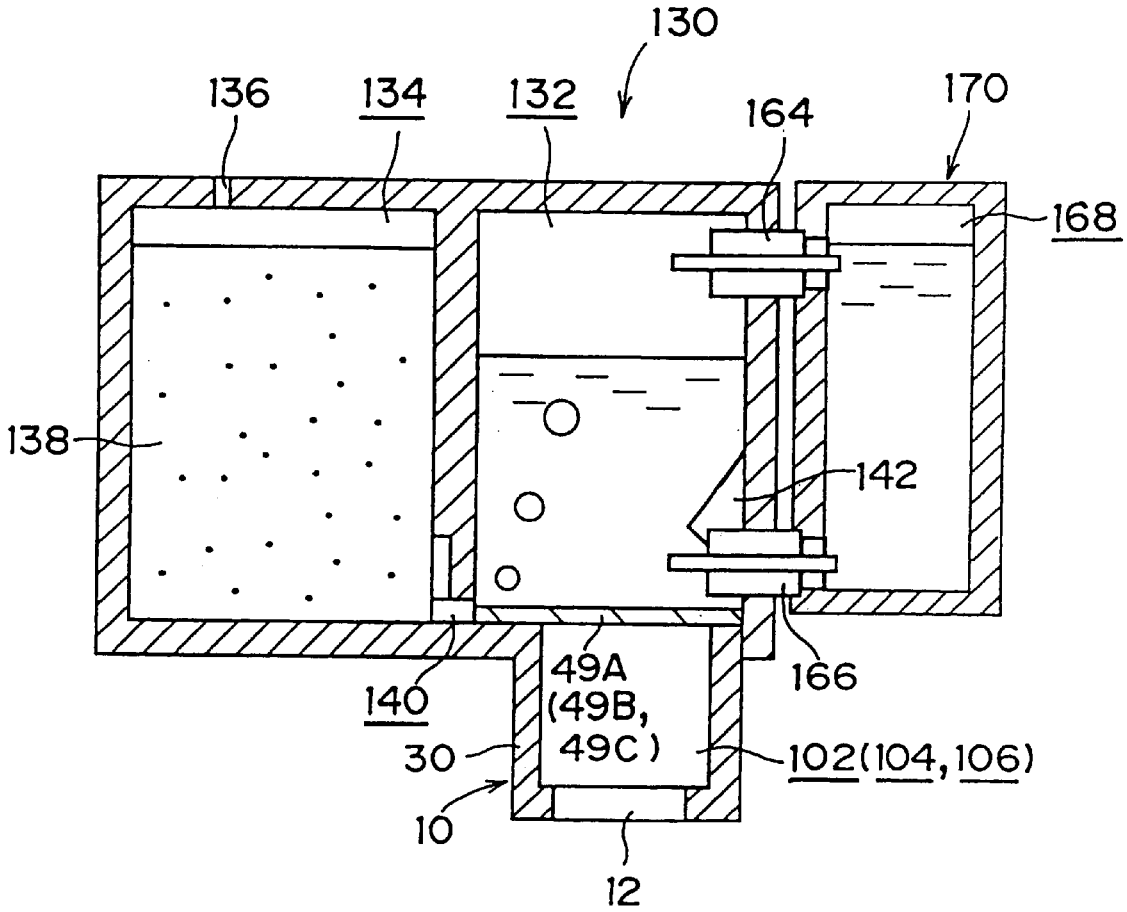
FIG. 14 is a schematic cross-sectional view, showing another example of the ink cartridge.

The ink cartridge 130 may have a structure shown in FIG. 14, for example. In this structure, a sub ink tank 170 having a sub ink chamber 168 in which ink is stored is connected via connecting ports 164 and 166 to the first ink chamber 132.

Figure 15:
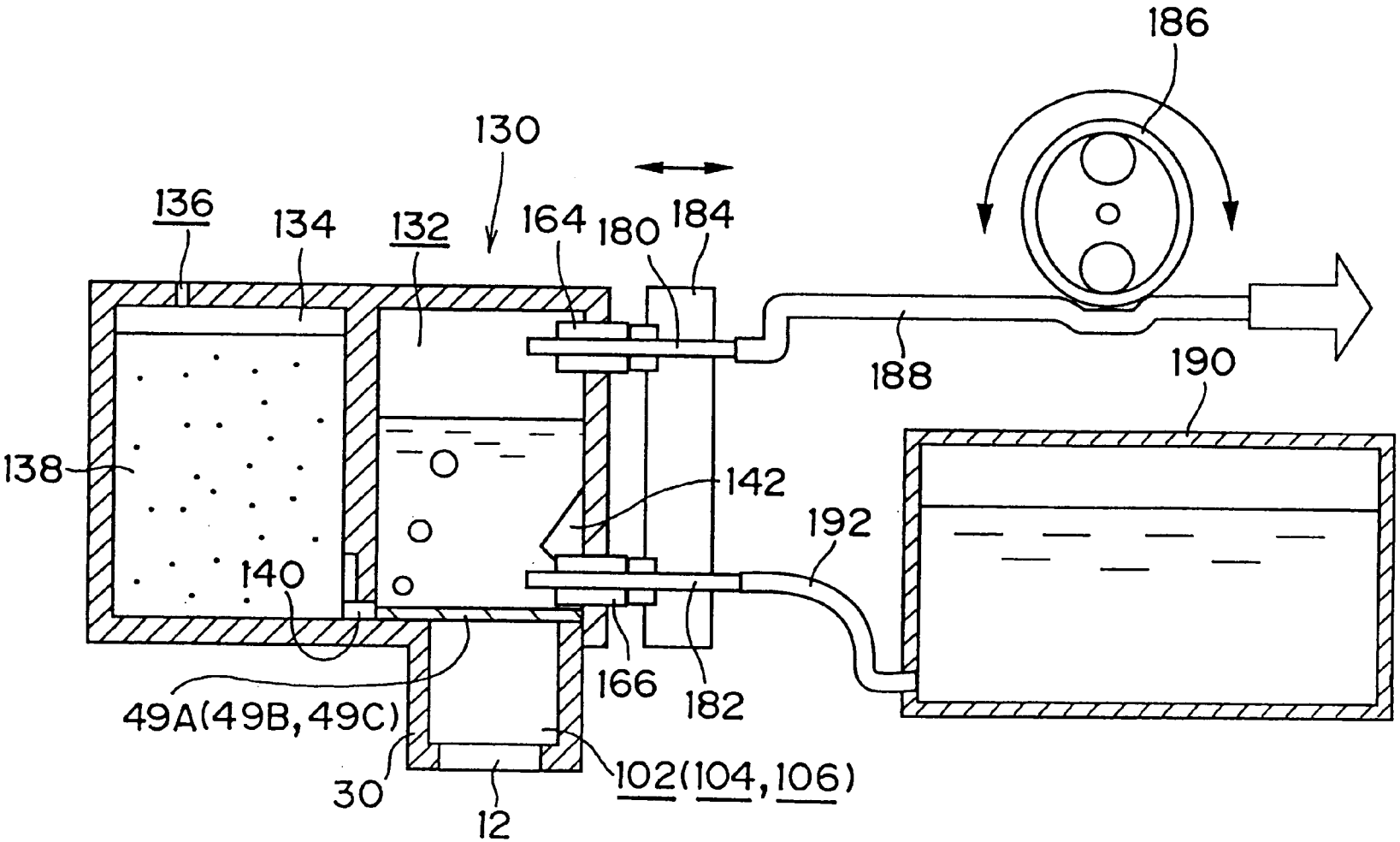
FIG. 15 is a schematic cross-sectional view, showing still another example of the ink cartridge.

Moreover, as shown in FIG. 15, a structure having a movable member 184, a tube 188, an ink tank 190, and a tube 192 can be used. Two pipes 180 and 182 respectively inserted into the connecting ports 164 and 166 are mounted at the movable member 184, and the movable member 184 is structured so as to freely move toward and away from the connecting ports 164 and 166. The tube 188 is connected to the pipe 180 and can discharge air to the outside by a pump 180. The ink tank 190 is provided inside the ink jet recording device 150 and has ink stored therein. The tube 192 connects the ink tank 190 to the pipe 182.

In this structure, when the amount of ink remaining in the ink cartridge 130 is detected by the ink jet recording device 150 via the prism 142, the movable member 184 is moved toward the ink cartridge 130 so that the pipes 180 and 182 are inserted into the connecting ports 164 and 166, respectively. By driving the pump 186, air in the first ink chamber 132 is discharged via the tube 188 to the outside, and at the same time, ink is supplied from the ink tank 190 via the tube 192 to the first ink chamber 132.

In this structure, the ink cartridge 130 (i.e., the ink jet recording head 10) can be used until the head portion is no longer durable.

Figure 16A:
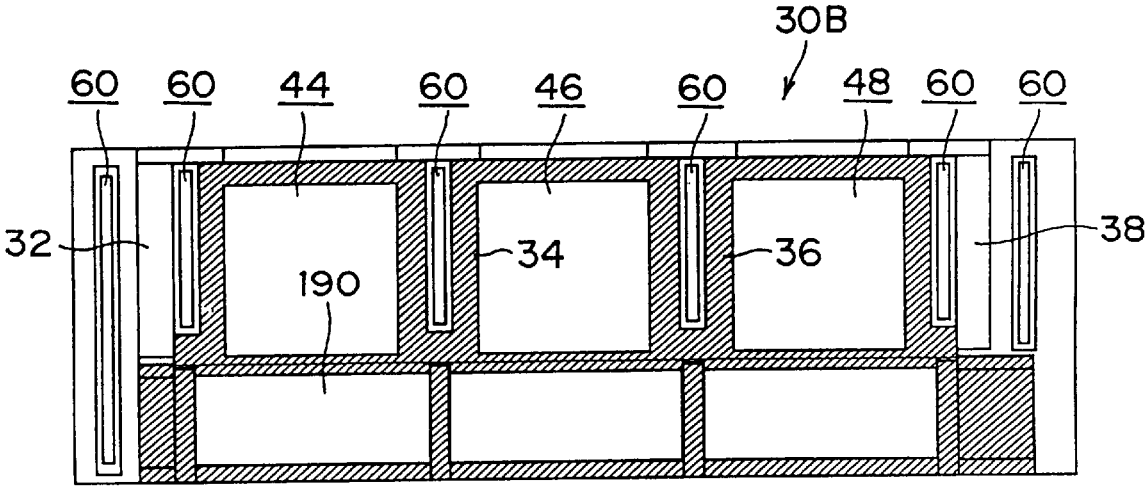
FIG. 16A is a plan view of a lower body according to a second embodiment of the present invention.
Figure 16B:
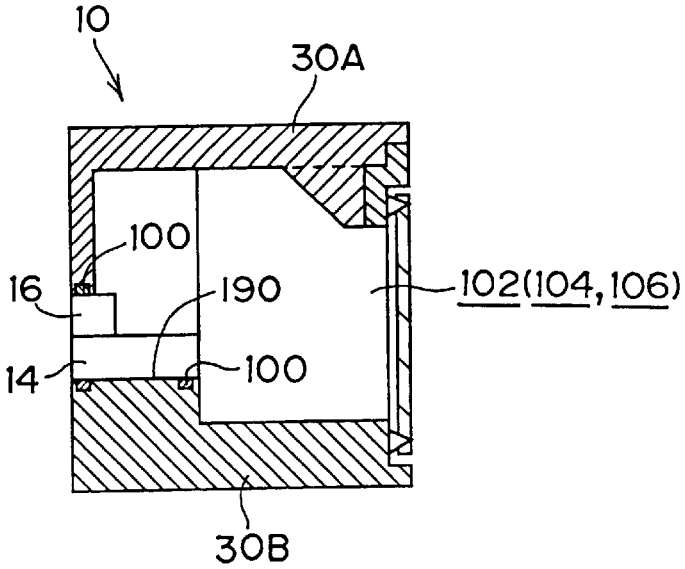
FIG. 16B is a cross sectional view of an ink jet recording head according to the second embodiment.
Figures 17A, 17B, 17C, 17D:
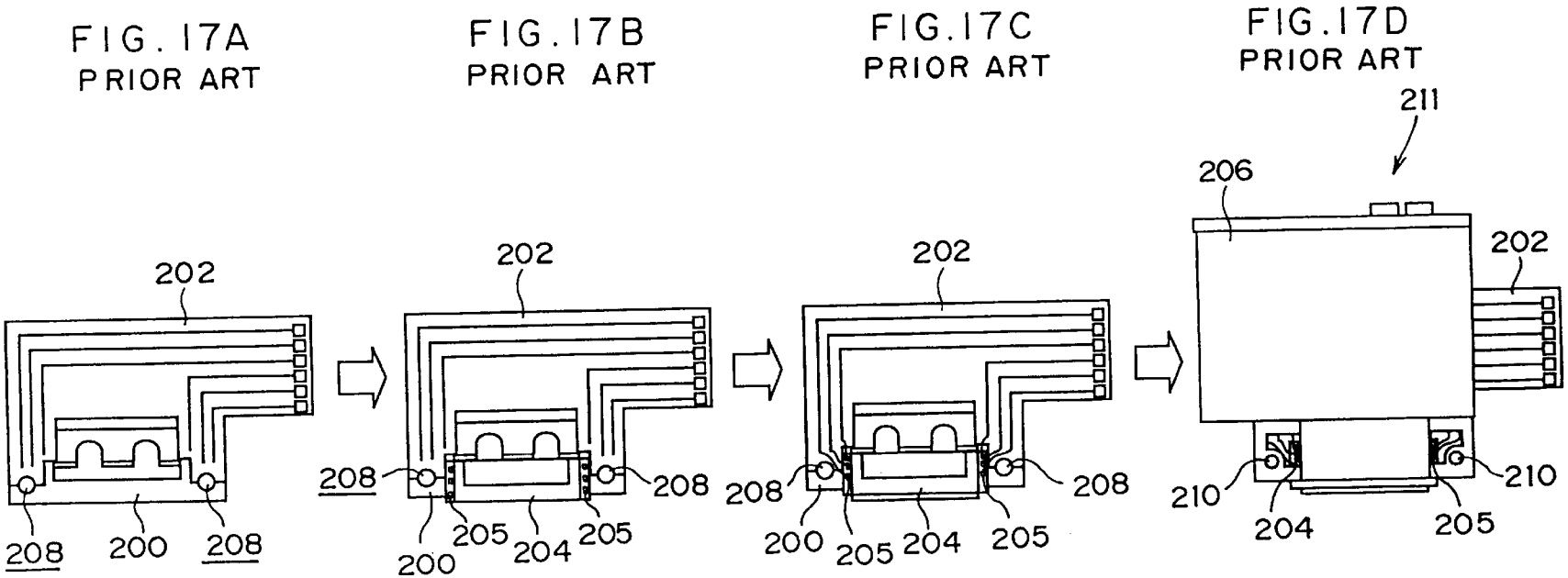
FIG. 17A PRIOR ART
FIG. 17B PRIOR ART
FIG. 17C PRIOR ART
FIG. 17D PRIOR ART
FIGS. 17A, 17B, 17C, and 17D are views showing the manufacturing process of an ink jet recording head according to a prior art embodiment.

Hereinafter, with reference to FIGS. 16A and 16B, a brief description will be given of an ink supplying structure according to a second embodiment of the present invention. Portions and parts of the present second embodiment which are common to those of the first embodiment are designated by the same reference numerals, and description thereof which may overlap the foregoing description will be appropriately omitted.

A manifold structure according to the second embodiment is characterized in that the lower body 30B has a flat platform 190 so as to support a predetermined area of the heating element substrate 14 of the head chip 12.

In this structure as well, effects similar to those of the first embodiment can be obtained.

Moreover, ink does not reach the bottom surface side (the heating element substrate 14) of the head chip 12. Therefore, when the ink jet recording head 10 is disposed so that the nozzle end face 12A is located vertically downward (i.e., so that the jetting direction of ink droplets is vertically downward), ink in the ink supply chambers 102 to 106 securely flows from the common liquid chambers 26A to 26C into the separate channels 24 and is jetted from the nozzles 22 as ink droplets. Namely, ink in the ink supply chambers 102 to 106 does not accumulate at the bottom surface side of the head chip. Therefore, ink can be used efficiently.

As described above, according to the present invention, a structure in which a head chip is cooled by ink is formed. Thus, no heat sink is necessary, and the structure can be made simple. Further, manufacturing efficiency can be improved since joining steps in the manufacturing process are reduced.

What is claimed is:

1. An ink jet recording head comprising:

a plurality of nozzles for jetting ink;

a plurality of separate channels each corresponding to one of the plurality of nozzles;

a plurality of common liquid chambers each communicating with one or more of the plurality of separate channels; and a plurality of ink supply chambers each communicating with one of the plurality of common liquid chambers, wherein the respective common liquid chambers open towards a direction in which the separate channels extend, and open towards a direction substantially perpendicular to the direction in which the separate channels extend so as to communicate with the corresponding ink supply chambers.

2. The recording head of claim 1, further comprising a head chip and an ink manifold to which the head chip is mounted, wherein the head chip includes the nozzles, the separate channels, and the common liquid chambers, and the ink manifold includes the ink supply chambers.

3. The recording head of claim 2, wherein the head chip comprises:

a heating element substrate having a heating element for jetting ink; and a channel forming substrate which is laminated on the heating element substrate and defines the separate channels and the nozzles.

4. The recording head of claim 2, wherein the head chip is pressed into an opening of the ink manifold and fixed therein via an elastic sealing element.

5. The recording head of claim 4, wherein the ink manifold has a surface which abuts against the head chip, the abutting surface having a concave portion formed therein, and the elastic sealing element is accommodated in the concave portion in such a way that a portion thereof protrudes from the concave portion, the elastic sealing element being pressed into the concave portion so as to perform a sealing function at a time of pressing the head chip into the opening of the ink manifold and fitting the head chip therein.

6. The recording head of claim 4, wherein the ink manifold and the elastic sealing element are produced by a two-color injection molding process.

7. The recording head of claim 2, further comprising a connecting terminal for electrical connection to the outside, the connecting terminal being provided at at least one end portion of the head chip in a direction intersecting the separate channels.

8. The recording head of claim 2, wherein the ink manifold is formed by a first half-body and a second half-body, and the head chip is pressed into the opening of the ink manifold and fixed therein while being interposed between the first half-body and the second half-body.

9. The recording head of claim 8, wherein the elastic sealing element is interposed between portions of the first half-body and the second half-body which abut against each other and between portions which abut against each other of the head chip and one of the first half-body and the second half-body.

10. A heatsinkless recording head having substantially no heat sink, the recording head comprising:

a head chip formed by laminated substrates;

an ink manifold having an opening for accommodating the head chip; and an elastic sealing element interposed between the head chip and the ink manifold when the head chip is accommodated in the ink manifold.

11. The recording head of claim 10, wherein the ink manifold is formed by a first half-body and a second half-body, and the head chip is pressed into the opening of the ink manifold and fixed therein while being interposed between the first half-body and the second half-body.

12. A manufacturing method of an ink jet recording head, the method comprising the steps of:

providing a head chip which includes a plurality of nozzles for jetting ink, a plurality of separate channels each corresponding to one of the plurality of nozzles, and a plurality of common liquid chambers each communicating with one or more of the plurality of separate channels;

providing an ink manifold which includes a plurality of ink supply chambers each communicating with one of the common liquid chambers; and assembling the head chip and the ink manifold in such a way that the respective common liquid chambers open towards a direction in which the separate channels extend, and open towards a direction substantially perpendicular to the direction in which the separate channels extend so as to communicate with the corresponding ink supply chambers.

13. The method of claim 12, wherein the head chip is formed by laminating a heating element substrate which has a heating element for jetting ink, and a channel forming substrate which defines the separate channels and the nozzles.

14. The method of claim 12, wherein the head chip is pressed into an opening of the ink manifold and fixed therein via an elastic sealing element.

15. The method of claim 14, wherein the ink manifold has a surface which abuts against the head chip, the abutting surface having a concave portion formed therein, and the elastic sealing element is accommodated in the concave portion in such a way that a portion thereof protrudes from the concave portion, the elastic sealing element being pressed into the concave portion so as to perform a sealing function at a time of pressing the head chip into the opening of the ink manifold and fitting the head chip therein.

16. The method of claim 12, wherein a connecting terminal for electrical connection to the outside is provided at at least one end portion of the head chip in a direction intersecting the separate channels.

17. The method of claim 12, wherein the ink manifold is formed by a first half-body and a second half-body, and the head chip is pressed into the opening of the ink manifold and fixed therein while being interposed between the first half-body and the second half-body.

18. The method of claim 17, wherein the elastic sealing element is interposed between portions of the first half-body and the second half-body which abut against each other, and is interposed between portions which abut against each other of the head chip and one of the first half-body and the second half-body.

19. An ink jet recording device, comprising:

(a) an ink jet recording head including:

a plurality of nozzles for jetting ink;

a plurality of separate channels each corresponding to one of the plurality of nozzles;

a plurality of common liquid chambers each communicating with one or more of the plurality of separate channels; and a plurality of ink supply chambers each communicating with one of the plurality of common liquid chambers, wherein the respective common liquid chambers open towards a direction in which the separate channels extend, and open towards a direction substantially perpendicular to the direction in which the separate channels extend so as to communicate with the corresponding ink supply chambers;

(b) an ink cartridge mounted at the ink jet recording head; and (c) a drive unit for moving the ink jet recording head and the ink cartridge in a scanning direction substantially perpendicular to a direction in which paper is conveyed.

20. An ink jet recording device, comprising:

(a) a heatsinkless ink jet recording head having substantially no heat sink, including:

a head chip formed by laminated substrates;

an ink manifold having an opening for accommodating the head chip; and an elastic sealing element interposed between the head chip and the ink manifold when the head chip is accommodated in the ink manifold;

(b) an ink cartridge mounted at the ink jet recording head; and (c) a drive unit for moving the ink jet recording head and the ink cartridge in a scanning direction substantially perpendicular to a direction in which paper is conveyed.

* * * * *